US006932431B2

(12) United States Patent
Koch et al.

(10) Patent No.: US 6,932,431 B2
(45) Date of Patent: Aug. 23, 2005

(54) CHAIR HAVING NOVEL TILT CONTROL MECHANISM

(75) Inventors: John Koch, Iowa City, IA (US); Ogden Olsen, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/463,760

(22) Filed: Jun. 13, 2003

(65) Prior Publication Data

US 2004/0251724 A1 Dec. 16, 2004

(51) Int. Cl.[7] ..... A47C 3/00
(52) U.S. Cl. ..... 297/301.5; 297/301.4
(58) Field of Search ..... 297/286, 289, 297/301.1, 301.2, 301.3, 301.4, 301.5, 301.6, 301.7, 300.6, 302.5

(56) References Cited

U.S. PATENT DOCUMENTS

| | | | | |
|---|---|---|---|---|
| 758,133 A | * | 4/1904 | Gilson | 297/301.4 |
| 1,501,181 A | | 7/1924 | Peters | |
| 2,105,510 A | | 1/1938 | Smith | |
| 2,211,090 A | | 8/1940 | Bolens et al. | |
| 2,410,871 A | | 11/1946 | Fields et al. | |
| 2,662,586 A | * | 12/1953 | Cramer | 297/291 |
| 2,680,474 A | * | 6/1954 | Fritz | 297/301.4 |
| 2,770,292 A | | 11/1956 | Hamilton et al. | |
| 3,441,311 A | | 4/1969 | Doerner | |
| 3,709,535 A | * | 1/1973 | Rothermel | 297/303.3 |
| 4,183,581 A | * | 1/1980 | Karrip et al. | 297/301.3 |
| 5,039,163 A | * | 8/1991 | Tolleson | 297/297 |
| 5,348,372 A | * | 9/1994 | Takamatsu et al. | 297/303.1 |
| 5,452,937 A | * | 9/1995 | Piretti | 297/301.4 |
| 5,658,045 A | | 8/1997 | Koolwijk et al. | |
| 6,039,398 A | * | 3/2000 | Gorgi et al. | 297/354.1 |
| 6,213,552 B1 | | 4/2001 | Miotto | |
| 6,220,664 B1 | * | 4/2001 | Lee | 297/301.7 |
| 6,276,755 B1 | | 8/2001 | Tung-Hua | |
| D460,870 S | | 7/2002 | Van De Riet et al. | |

FOREIGN PATENT DOCUMENTS

| | | | | |
|---|---|---|---|---|
| DE | 3605809 A1 | * | 8/1987 | A47C/1/024 |
| JP | 03268704 A | * | 11/1991 | A47C/3/026 |

* cited by examiner

*Primary Examiner*—Peter M. Cuomo
*Assistant Examiner*—Stephen D'Adamo
(74) *Attorney, Agent, or Firm*—Sandra B. Weiss; Jones Day

(57) ABSTRACT

A chair having a chair seat and a chair back includes a means for controlling the tilt of the chair back relative to the chair seat, the tilt means comprising a control body mounted beneath the chair seat and a pivot body pivotably mounted beneath the control body. A spring is operatively disposed between the control body and the pivot body. The control means comprises means for limiting the range of angular motion of the pivot body. Further, the locations of the control body, the pivot body, and the rod about which the pivot body pivots are each optimized to reduce the shear force that is applied to the user's back when the user exerts a force against the chair back.

14 Claims, 8 Drawing Sheets

CHAIR HAVING NOVEL TILT CONTROL MECHANISM

BACKGROUND OF THE INVENTION

This invention relates to chairs that are adjustable for the comfort of the user. In particular, this invention relates to chairs such as are suitable for use in an office environment and in which the angle of the back rest relative to the seat rest can be easily adjusted by the user for his or her individual comfort.

It is known that the efficiency and productivity of office workers is dependent in part on their physical comfort. An important aspect of physical comfort is chairs that can be adjusted to suit the needs of a particular user. Designing office chairs for this purpose can be challenging, because each chair must be adjustable to accommodate users of many different heights and weights. The chair also should be adjustable to accommodate a variety of different seating postures. In particular, it is frequently desirable for a chair back rest to recline from the upright position in a manner adjustable by each user. Some prior art chairs having reclining seat backs exert a shear force on the user's back when reclining in the chair; this shear force can be so great that it causes the user's shirt to be pulled out of place. It would be desirable for a seat back of a chair to be able to recline without creating an uncomfortable amount of shear against the user's back. Further, the adjustment of the reclining angle should be independent of the height adjustment of the seat, or of any other adjustments.

U.S. Pat. No. 1,501,181 discloses an office chair having a reclining back rest by means of a pivoting supporting arm, and having a spring that provides a counterforce.

U.S. Pat. No. 2,105,510 discloses a chair having a back rest that can be inclined by releasing and tightening wing nuts on bolts, and having a spring for controlling the tension of the back rest.

U.S. Pat. No. 2,211,090 discloses an office chair with a reclining back, the back being pivotably connected to a mounting member which is in turn pivotably mounted on the chair spindle.

U.S. Pat. No. 2,410,871 discloses a chair having a back support including a spring that is retained in position by cups at either of its ends.

U.S. Pat. No. 2,680,474 discloses a chair having a back rest connected to an arm that pivots about a pivot rod, the rotation of the pivot rod being controlled by stops.

U.S. Pat. No. 2,770,292 discloses an office chair with a spring mounted back, the back support being pivotally mounted to the chair seat, the spring providing yieldingly opposing rearward swinging of the back from a normal position, and wherein the spring-mounted back can be adjusted forwardly and rearwardly with respect to the chair seat.

U.S. Pat. No. 3,441,311 discloses a chair control in which the spring mechanism that resists the tilting action of the chair seat or back is mounted perpendicular to the pivotally connected frame members.

U.S. Pat. No. 5,452,937 discloses a chair having a reclining chair back, which chair back is mounted on an arm attached to a pivot point under seat and having a spring that applies a counterforce to the pivoting action.

U.S. Pat. No. 5,658,045 discloses a chair having a mechanism for synchronous adjustment of the seat and backrest. The position is maintained by a catch mechanism which is released by operation of an actuation lever.

U.S. Pat. No. D460,870 is a design of an office chair.

U.S. Pat. No. 6,213,552 discloses an office chair in which the angle of the back is adjusted synchronously with the angle of the seat.

U.S. Pat. No. 6,276,755 discloses as prior art an office chair having a back on a back support that inclines with respect to the chair seat.

U.S. patent application Publication No. US 2002/0043845 A1 discloses a chair having a spring and a preload member, and discloses a method of installing the spring.

U.S. patent application Publication No. US 2003/0075961 A1 discloses an office chair having a track by which the seat part can move forward and upward or downward and rearward, and having a swivel device.

It is thus one object of the invention to provide a chair with a tiltable back rest.

It is another object of the invention to provide a chair with a tiltable back rest which is comfortable for the user and which does not result in excessive shear force on the user's back when the user exerts force against the backrest so as to cause it to recline.

It is still another object of the invention to provide a chair with a tiltable back rest which is comfortable for the user and which does not result in excessive shear force on the user's back when the user exerts force against the backrest so as to cause it to recline, and which is of relatively simple design.

It is yet another object of the invention to provide a chair with a tiltable back rest which is comfortable for the user and which does not result in excessive shear force on the user's back when the user exerts force against the backrest so as to cause it to recline, and which is of relatively simple design, and which can be locked so as to maintain the back rest in the upright position.

SUMMARY OF THE INVENTION

In accordance with the invention, a chair having a chair seat and a chair back includes a means for controlling the tilt of the chair back relative to the chair seat. The means for controlling the tilt of the chair back comprises a control body mounted beneath the chair seat and a pivot body pivotably mounted beneath the control body, and further comprising means for operatively connecting the chair back to the pivot body. A spring is operatively disposed between the control body and the pivot body. The control means comprises means for limiting the range of angular motion of the pivot body. When a person seated in the chair leans backward to exert a force against the chair back, the control body will limit the angular motion of the pivot body and thereby limit the angular motion of the chair back. The spring will exert a counterforce to return the chair back to its upright position when the user no longer exerts the backward force against the chair back. Further, the locations of the control body, the pivot body, and the rod about which the pivot body pivots are each optimized to reduce the shear force that is applied to the user's back when the user exerts a force against the chair back.

In a preferred embodiment, the chair of the instant invention includes a tilt lock mechanism whereby a user can lock the chair back in the upright position.

DESCRIPTION OF THE FIGURES

The present invention will be more readily understood by reference to the figures, in which like reference numerals indicate like parts, and wherein.

DESCRIPTION OF THE PREFERRED EMBODIMENT

Figure 1:
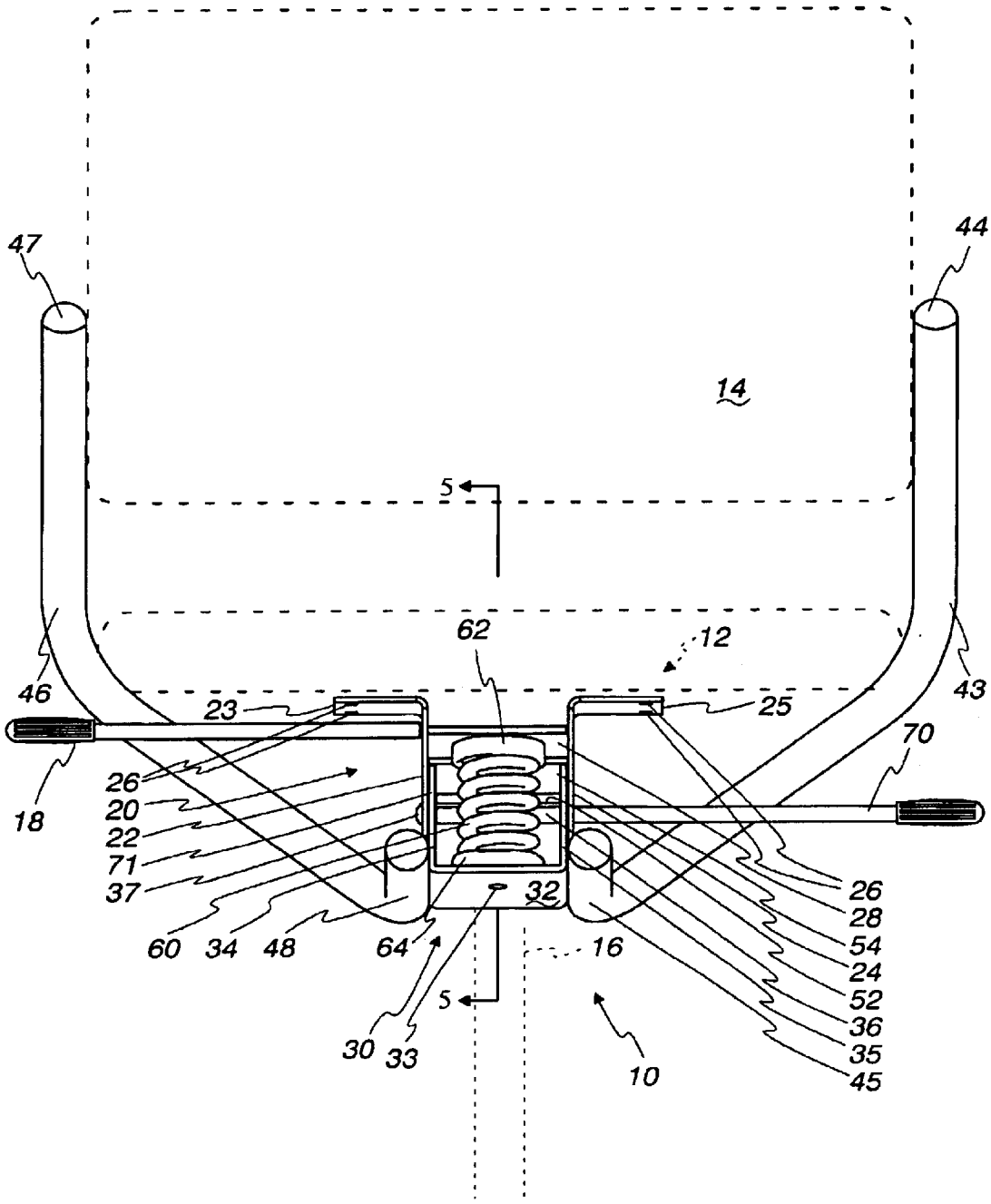
FIG. 1 is a front upwardly directed perspective view of the tilt mechanism of the instant invention, showing the chair seat and chair back in phantom lines.
Figure 2:
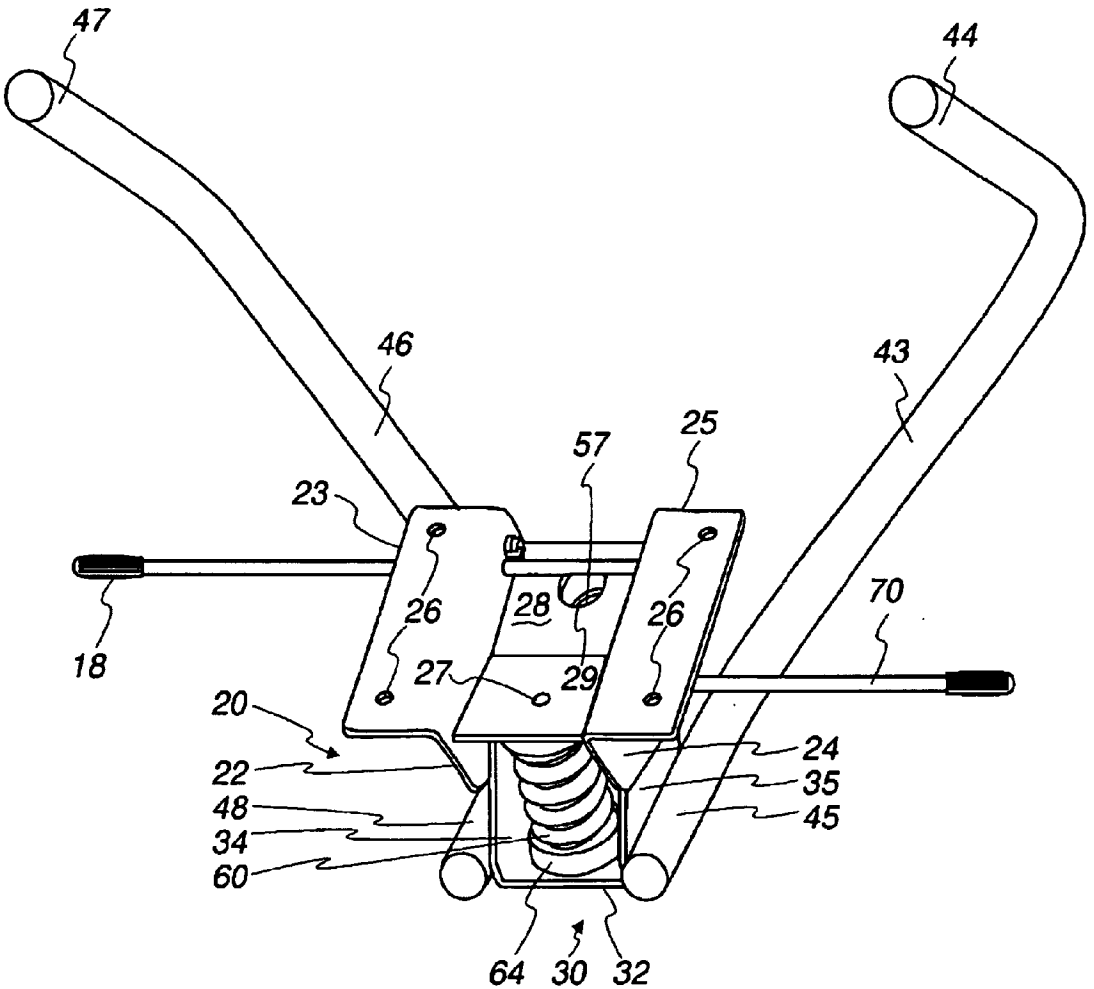
FIG. 2 is a front downwardly directed ¾ view of the tilt mechanism of the instant invention.
Figure 3:
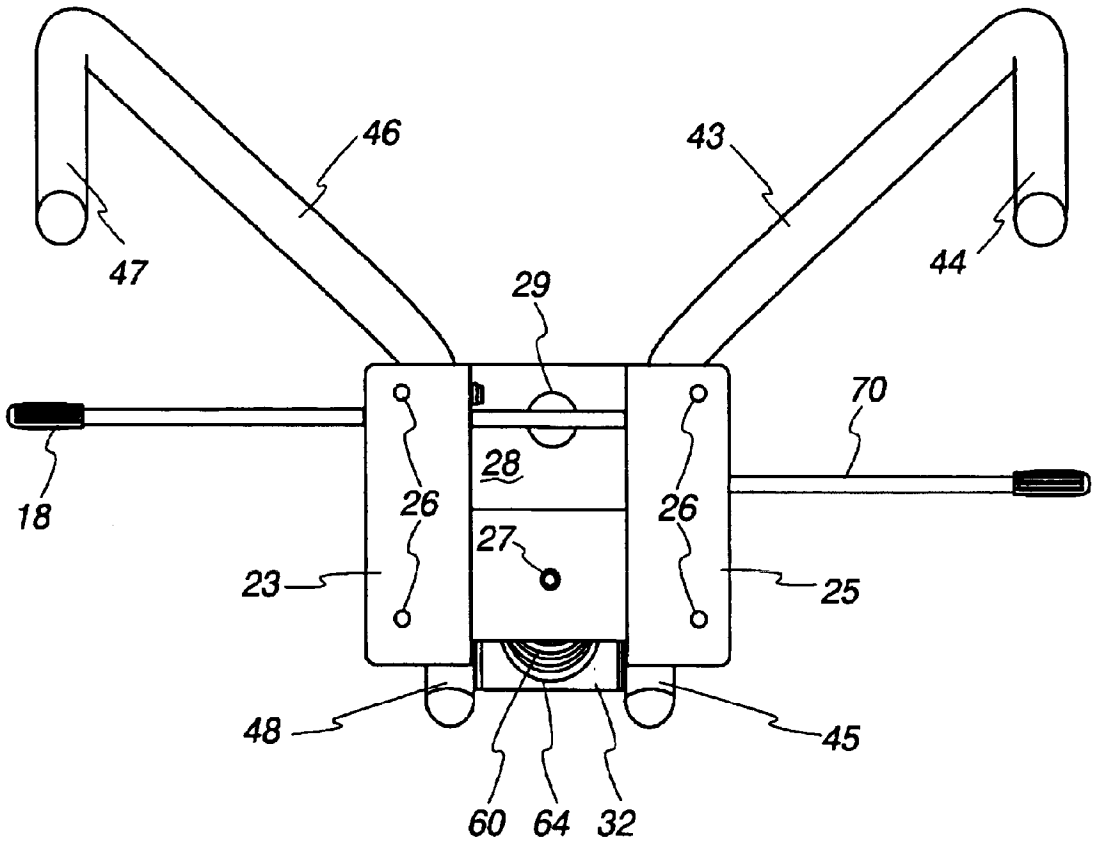
FIG. 3 is a top plan view of the tilt mechanism of the instant invention.

Referring now to FIG. 1, a chair 10 comprises a chair seat 12 and a separate chair back 14, such that chair back 14 can tilt independently of chair seat 12. Chair seat 12 is mounted on pedestal 16 which may include an optional gas cylinder (not shown) for seat height adjustment, such as is known in the art, said gas cylinder being operable by seat height adjustment lever 18, also known in the art.

The tilt control mechanism of the chair 10 comprises a control body 20. In the illustrated embodiment, control body 20 comprises two side plates 22, 24, each side plate 22, 24 having an upper horizontal flange 23, 35, respectively, for securing control means 20 to the underside of seat 12. Orifices 26 in flanges 23, 25 can accommodate bolts, screws, rivets or other means suitable for fastening seat 12 to flanges 23, 25. Control body 20 further comprises substantially horizontal top plate 28, which can be welded at its longitudinal edges to the inside surfaces of side plates 22,24. Top plate 28 has a first orifice 27 to receive a boss on a spring retainer cup as described below, and a second orifice 29 through which can pass the pedestal 16 or optional gas cylinder.

Disposed beneath control body 20 and forward of pedestal 16 is pivot body 30, which in the illustrated embodiment is a U-shaped plate comprising base member 32 with orifice 33 and upwardly extending arms 34, 35. Pivot body 30 pivots about pivot rod 36, which passes through orifice 40 in side plate 24, orifice 42 in side plate 22 and corresponding aligned orifices in upwardly extending arms 34, 35 of pivot body 30. Pivot rod 36 terminates at pivot rod head 37 mounted to the outer surface of control side plate 22.

Means for operatively connecting pivot body 30 to said seat back 14 can comprise structural tubing or rods of sufficient strength to maintain rigidity in response to the force of a user pressing against the seat back 14. In the illustrated embodiment, tubing members 43, 46 are joined near their upper ends 44, 47 to seat back 14, and at their lower ends 45, 48 are joined such as by welding to pivot body 30. In the illustrated embodiment, upper ends 44, 47 are joined to the sides of seat back 14. It will be understood that in this embodiment upper ends 44, 47 could be extended horizontally forward to define arm rests or arm rest supports. It will be further understood, however, that upper ends 44, 47 of tubing members 43, 46 could be secured at other locations on seat back 14. Similarly, in the illustrated embodiment, lower ends 45, 48 are secured by welding to the outer surfaces of upwardly extending arms 34, 35 of pivot body 30, but it will be understood that lower ends 45, 48 of tubing members 43, 46 could be secured elsewhere on pivot body 30, so long as such securement does not impede the pivoting motion thereof.

Figure 5:
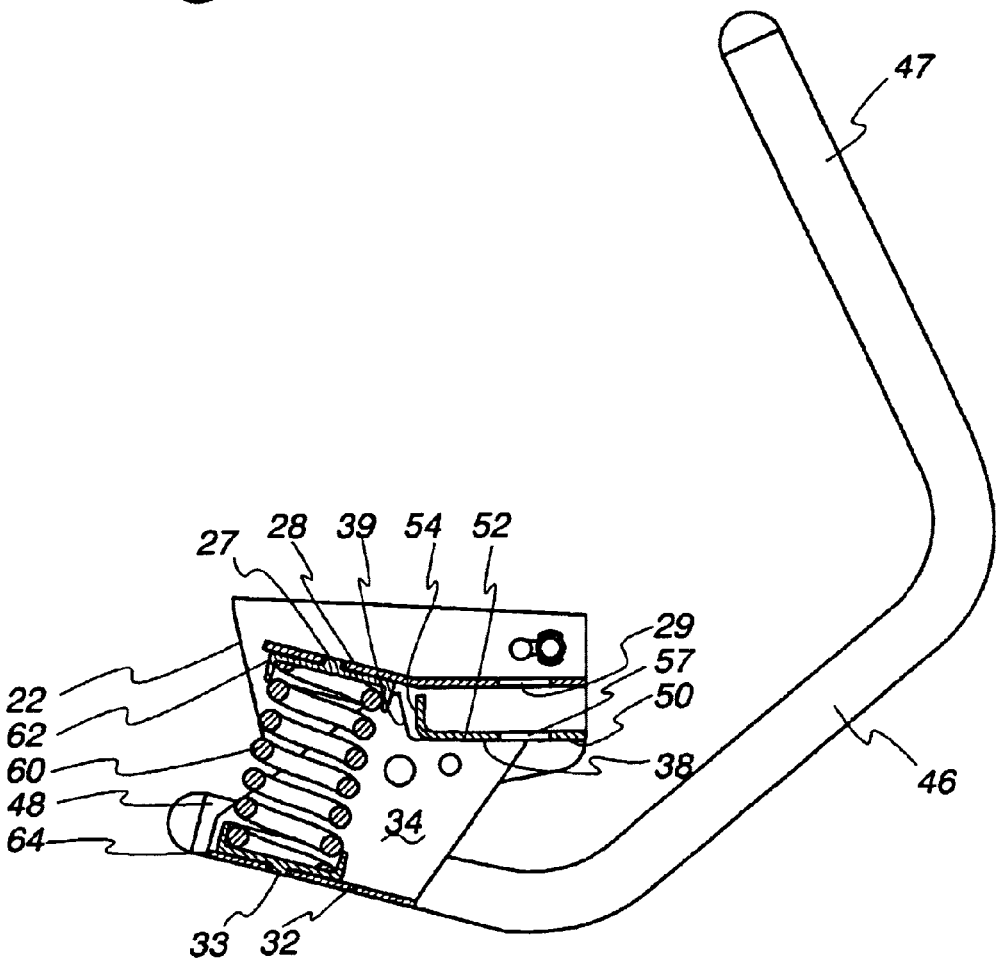
FIG. 5 is a cross sectional view through the center of the tilt mechanism of the instant invention, viewed from the left side.
Figure 6:
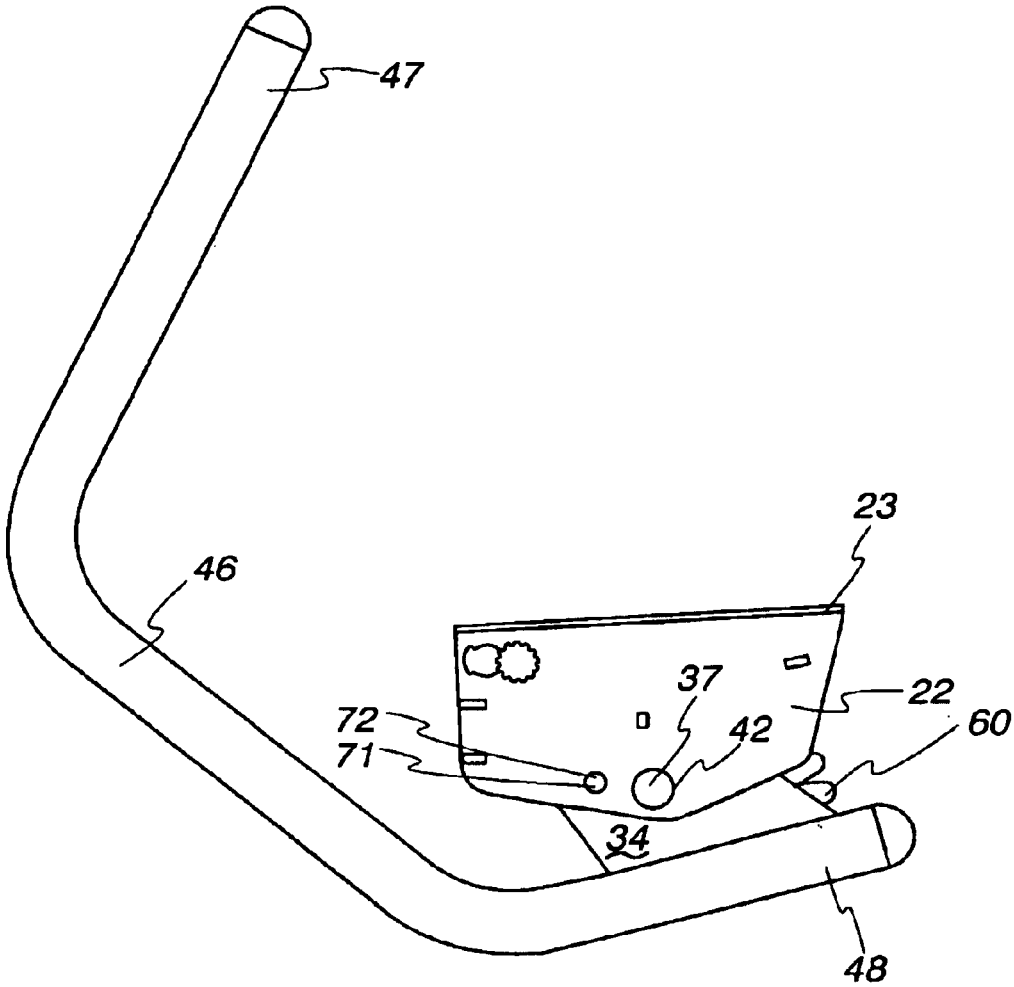
FIG. 6 is a view of the right side of the tilt mechanism of the instant invention.
Figure 7:
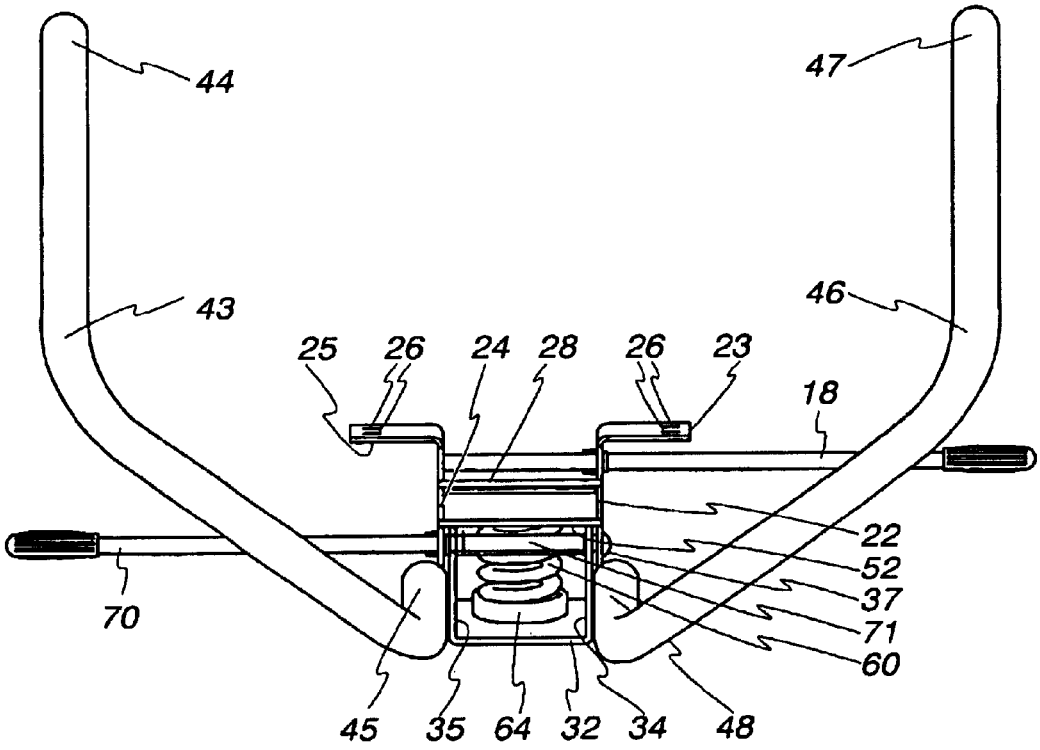
FIG. 7 is a rear view of the tilt mechanism of the instant invention.
Figure 8:
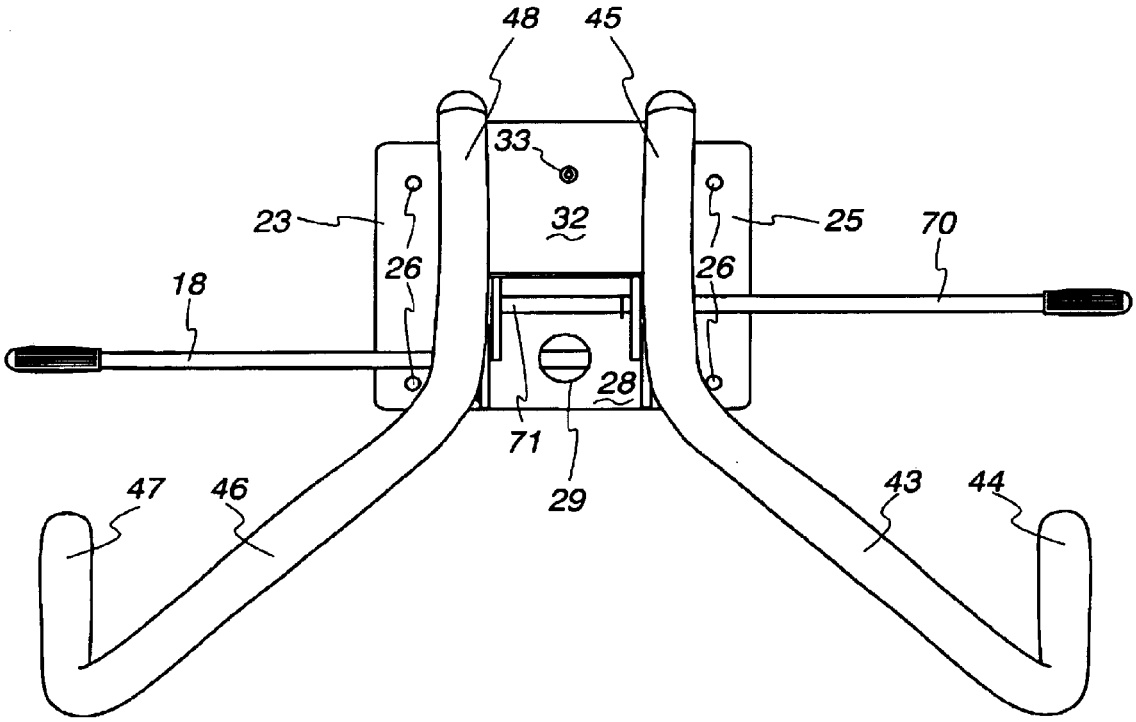
FIG. 8 is a bottom plan view of the tilt mechanism of the instant invention.

Control means 20 further comprises means for limiting the range of angular motion of pivot body 30. As best seen in FIG. 5, said means for limiting the range of angular motion of pivot body 30 comprises a limiting member 50 having a front stop surface 52 and a back stop surface 54, and an orifice 57 for receiving the pedestal or optional gas cylinder, said orifice 57 being in alignment with orifice 29. Each upwardly extending arm 34, 35 of pivot body 30 further comprises a front stop mating surface 38 and a back stop mating surface 39. Limiting member 50 is formed so that front stop surface 52 and back stop surface 54 are at a first predetermined angle with respect to one another. In the illustrated embodiment, front stop surface 52 is substantially horizontal and back stop surface 54 is substantially vertical, such that the angle between them is about 90°. Further, front stop mating surfaces 38 and back stop mating surfaces 39 of arms 34, 35 of pivot body 30 are at a second predetermined angle with respect to one another, said second predetermined angle being greater than said first predetermined angle, and shown in the illustrated embodiment as being about 105°. Generally, the difference between the two predetermined angles will be on the order of about 12–18°, and preferably about 15°.

A spring 60 is disposed between base member 32 of pivot body 30 and top plate 28 of control body 20, and is maintained in position by retaining cups 62, 64 fixedly secured to the inwardly facing surfaces of top plate 28 and base member 32, respectively. In the illustrated embodiment, retaining cup 62 has on its flat outer surface a boss that fits into orifice 27 of top plate 28, and retaining cup 64 has on its flat outer surface a boss that fits into orifice 33 of pivot body base member 32. Spring 60 will be of sufficient force to return pivot body 30, tubing 43, 46, and chair back 14 to their upright positions when force against chair back 14 is removed.

In operation a user will be seated in chair 10 in conventional manner. If the user desires to recline the seat back 14, the user will simply lean backward to apply a force to seat back 14. This force will be transmitted through tubing 43, 46 to pivot body 30, which will pivot about pivot rod 36 until back stop mating surfaces 39 of arms 34, 35 engage back stop surface 54 of limiting member 50. When the surfaces are so engaged, pivot body 30 cannot pivot any further, and therefore chair back 14 cannot recline any further. It will be seen that the angle through which chair back 14 can recline is limited by the difference between the predetermined angle between front and back stop mating surfaces 38, 39 of pivot body 30, and the predetermined angle between front and back stop surfaces 52, 54 of limiting member 50. As pivot body 30 pivots about pivot rod 36, spring 60 is compressed between control body 20 and pivot body 30. When the user is no longer exerting full force against chair back 14, the spring 60 will exert a downward force on base member 32 of pivot body 30, which downward force will be transmitted through tubing 43, and 46, and cause chair back 14 to return to its upright position. It will be noted that chair seat 12 and control body 20 do not tilt or pivot.

Figure 4:
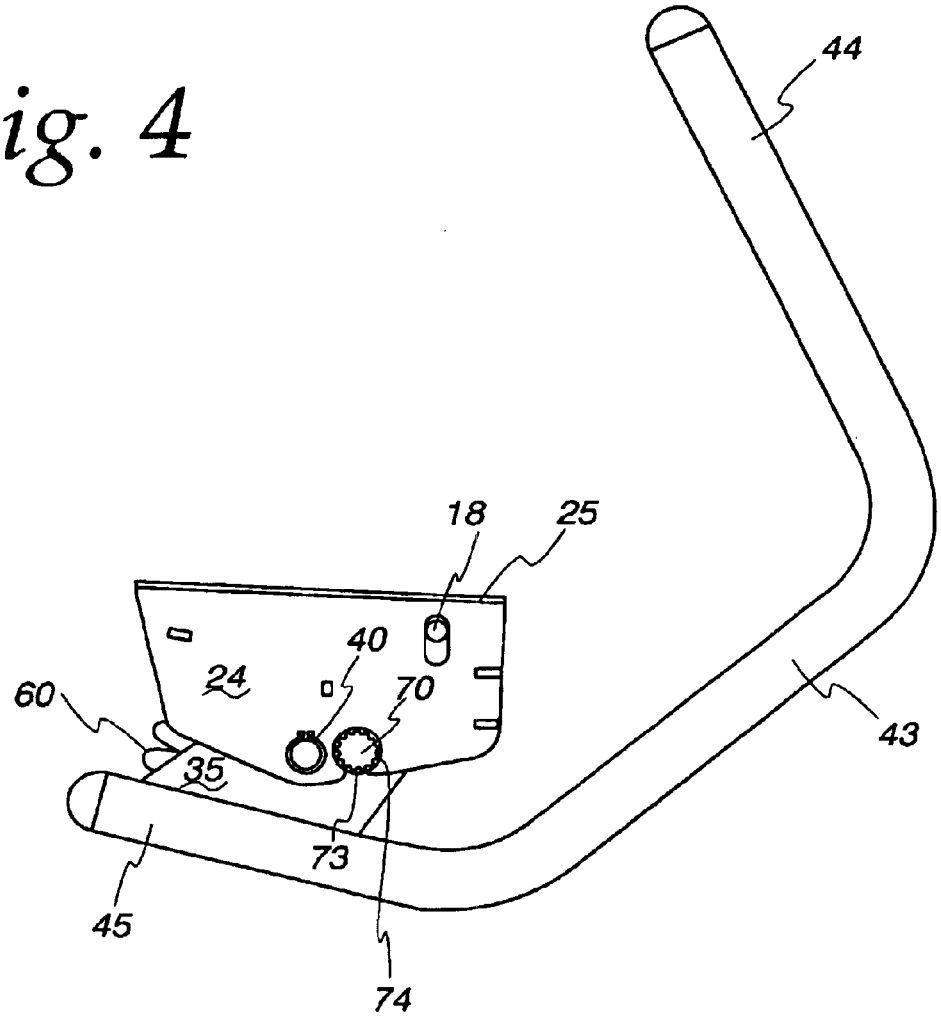
FIG. 4 is a view of the left side of the tilt mechanism of the instant invention.

In a preferred embodiment, the tilt mechanism of the instant invention will further include a lock mechanism to prevent seat back 14 from reclining. As best seen in FIG. 4, the lock mechanism comprises locking lever 70 that passes through washer 73 and slot 72 in side plate 24, and through corresponding aligned orifices in each of upwardly extending arms 34, 35 of pivot body 30. The end 71 of locking lever 70 is releasably engageable in orifice 72 in side plate 22. The washer 73 is also releasably engageable in orifice 74. When end 71 is not engaged in orifice 72 and washer 73 is not engaged in orifice 74, then pivot body 30 can rotate with respect to control body 20, and lock lever 70 moves up and down through slot 74 in side plate 24. When it is desired to lock chair back 14 in its upright position, locking lever 70 is pushed transversely until end 71 is engaged in orifice 72 in side plate 22. This prevents any rotation of pivot body 30 with respect to control body 20, so that chair back 14 cannot be reclined.

An advantage of the chair of the invention is that the pivot rod 36, pivot body 30 and control body 20 each can be positioned so as to reduce the shear force exerted on a user's back when reclining in the chair. This shear force, known as "shirt pull," is attributable to the difference between the action of the actual back motion experienced by the user and the user's natural motion in reclining. This difference in forces results in friction on the user's back and can cause the user's shirt to be pulled out of place. This effect is reduced in the instant invention by positioning the control body 20, pivot body 30, and pivot rod 36 so that the motion of the pivot body 30 and the associated chair back 14 while reclining is optimally aligned with the user's natural rotation about their hips when reclining.

While a preferred embodiment of the invention has been illustrated and described, it should be understood that the invention is not so limited, and modifications may be made without departing from the invention. The scope of the invention is defined by the appended claims, and all devices that come within the meaning of the claims, either literally or by equivalents, are intended to be embraced therein.

What is claimed is:

1. A tiltable chair comprising a chair seat;

a chair back; and a control means for controlling the tilt of the chair back relative to the chair seat, said control means comprising a control body mounted to the underside of said chair seat, a pivot body pivotably mounted beneath said control body to have a range of pivoting motion, connecting means for operatively connecting said pivot body to said chair back, and a spring operatively disposed between said control body and said pivot body;

whereby force exerted backwardly against said chair back is transmitted through said connecting means to said pivot body, such that said pivot body pivots, said control means further comprising limiting means for limiting the range of pivoting motion of said pivot body, such that pivoting motion of said pivot body is limited by said spring and by said limiting means, thereby limiting the tilting movement of said chair back, and wherein said limiting means comprises an additional limiting member having a front stop surface and a back stop surface, and wherein said pivot body further comprises a front stop mating surface and a back stop mating surface, whereby when said chair back is in its forwardmost position said front stop mating surface of said pivot body engages said front stop surface of said limiting member, and when said chair back is in its backwardmost position said back stop mating surface of said pivot body engages said back stop surface of said limiting member;

wherein said front stop surface and said back stop surface are each disposed rearwardly of said spring.

2. A tiltable chair comprising a chair seat;

a chair back; and a control means for controlling the tilt of the chair back relative to the chair seat, said control means comprising a control body mounted to the underside of said chair seat, a pivot body pivotably mounted beneath said control body to have a range of pivoting motion, connecting means for operatively connecting said pivot body to said chair back, and a spring operatively disposed between said control body and said pivot body;

whereby force exerted backwardly against said chair back is transmitted through said connecting means to said pivot body, such that said pivot body pivots, said control means further comprising limiting means for limiting the range of pivoting motion of said pivot body, such that pivoting motion of said pivot body is limited by said spring and by said limiting means, thereby limiting the tilting movement of said chair back, and wherein said limiting means comprises a limiting member having a front stop surface and a back stop surface, said front and back stop surfaces being located rearwardly of said spring, said tiltable chair further comprising a tilt lock means operatively connected to said control body and said pivot body.

3. The tiltable chair of claim 2 wherein said front stop surface and said back stop surface of said limiting member are at a first predetermined angle with respect to one another, and said front stop mating surface and said back stop mating surface of said pivot body are at a second predetermined angle with respect to one another, said second predetermined angle being greater than said first predetermined angle, the difference between the two predetermined angles defining the angular range of motion of said chair back.

4. The tiltable chair of claim 3 wherein the difference between the two predetermined angles is on the order of about 12–18°.

5. A tiltable chair comprising a chair seat;

a chair back; and a control means for controlling the tilt of the chair back relative to the chair seat, said control means comprising a control body mounted to the underside of said chair seat, a pivot body pivotably mounted beneath said control body to have a range of pivoting motion, connecting means for operatively connecting said pivot body to said chair back, and a spring operatively disposed between said control body and said pivot body;

whereby force exerted backwardly against said chair back is transmitted through said connecting means to said pivot body, such that said pivot body pivots, said control means further comprising limiting means for limiting the range of pivoting motion of said pivot body, such that pivoting motion of said pivot body is limited by said string and by said limiting means, thereby limiting the tilting movement of said chair back, and wherein said limiting means comprises a limiting member having a front stop surface and a back stop surface, said control body further comprising means for receiving a seat height adjustment means, wherein said front stop surface and said back stop surface are located rearwardly of said spring.

6. A tiltable chair comprising a chair seat;

a chair back; and a control means for controlling the tilt of the chair back relative to the chair seat, said control means comprising a control body mounted to the underside of said chair seat, a pivot body pivotably mounted beneath said control body to have a range of pivoting motion, a connecting member affixed to said pivot body for operatively connecting said pivot body to said chair back, and a spring operatively disposed between said control body and said pivot body;

whereby force exerted backwardly against said chair back is transmitted through said connecting member to said pivot body, such that said pivot body pivots, said control means further comprising limiting means for limiting the range of pivoting motion of said pivot body, such that pivoting motion of said pivot body is limited by said spring and by said limiting means thereby limiting the tilting movement of said chair back, and wherein said limiting means comprises a limiting member having a front stop surface and a back stop surface, and wherein said pivot body further comprises a front stop mating surface and a back stop mating surface, whereby when said chair back is in its forwardmost position said front stop mating surface of said pivot body engages said front stop surface of said limiting member, and when said chair back is in its backwardmost position said back stop mating surface of said pivot body engages said back stop surface of said limiting member.

7. The tiltable chair of claim 6 wherein said front stop surface and said back stop surface are located rearwardly of said spring.

8. The tiltable chair of claim 6 wherein said front stop surface and said back stop surface of said limiting member are at a first predetermined angle with respect to one another, and said front stop mating surface and said back stop mating surface of said pivot body are at a second predetermined angle with respect to one another, said second predetermined angle being greater than said first predetermined angle, the difference between the two predetermined angles defining the angular range of motion of said chair back.

9. The tiltable chair of claim 8 wherein the difference between the two predetermined angles is on the order of about 12–18°.

10. The tiltable chair of claim 6 wherein said front stop surface and said back stop surface of said limiting member are at a first predetermined angle with respect to one another, and said front stop mating surface and said back stop mating surface of said pivot body are at a second predetermined angle with respect to one another, said second predetermined angle being greater than said first predetermined angle, the difference between the two predetermined angles defining the angular range of motion of said chair back.

11. The tiltable chair of claim 10 wherein the difference between the two predetermined angles is on the order of about 12–18°.

12. The tiltable chair of claim 10 wherein said front stop surface and said back stop surface are each disposed rearwardly of said spring.

13. The tiltable chair of claim 10 further comprising a tilt lock means operatively connected to said control body and said pivot body.

14. The tiltable chair of claim 10, said control body further comprising means for receiving a seat height adjustment means.

* * * * *

UNITED STATES PATENT AND TRADEMARK OFFICE

CERTIFICATE OF CORRECTION

PATENT NO. : 6,932,431 B2
APPLICATION NO. : 10/463760
DATED : August 23, 2005
INVENTOR(S) : John Koch et al.

It is certified that error appears in the above-identified patent and that said Letters Patent is hereby corrected as shown below:

In Column 8, line 1, Claim 8, after claim of, delete "6" and insert therefore -- 1 --

Signed and Sealed this

Fifteenth Day of April, 2008

JON W. DUDAS
*Director of the United States Patent and Trademark Office*